United States Patent [19]

Mayfield et al.

[11] Patent Number: 4,871,025

[45] Date of Patent: Oct. 3, 1989

[54] LEVELLING MACHINE

[76] Inventors: Trevor K. Mayfield; Lindsay F. Radcliffe, both of Ninth Street, Kerang, Victoria, Australia, 3579

[21] Appl. No.: 118,650

[22] Filed: Nov. 9, 1987

[51] Int. Cl.[4] ..... E02F 3/76; E01C 19/20

[52] U.S. Cl. ..... 172/4.5; 172/799.5; 404/84; 404/101; 404/110

[58] Field of Search ..... 172/4.5, 799.5, 4; 404/84, 110, 101; 37/DIG. 20, DIG. 13, 101

[56] References Cited

U.S. PATENT DOCUMENTS

| | | | |
|---|---|---|---|
| 2,546,907 | 3/1951 | Sherwood | 404/110 X |
| 3,213,769 | 10/1965 | Smith | 404/110 |
| 3,334,560 | 8/1967 | Long | 172/4.5 X |
| 3,466,989 | 9/1969 | Ulrich et al. | 404/104 |
| 3,770,065 | 11/1973 | Gill et al. | 172/4.5 |
| 3,909,146 | 9/1975 | Hoffman | 404/110 |
| 4,012,160 | 3/1977 | Parker | 404/84 |
| 4,162,708 | 7/1979 | Johnson | 37/DIG. 20 |
| 4,188,152 | 2/1980 | Kitt | 404/110 |
| 4,299,290 | 11/1981 | Nunes, Jr. | 172/4.5 |
| 4,308,677 | 1/1982 | Behm | 37/129 X |
| 4,329,081 | 5/1982 | Buvik | 404/110 |
| 4,395,156 | 7/1983 | Sprague, III | 404/110 |
| 4,413,684 | 11/1983 | Duncklee | 172/4.5 |

*Primary Examiner*—Richard J. Johnson
*Assistant Examiner*—Jeffrey L. Thompson
*Attorney, Agent, or Firm*—Henry Sternberg; Bert J. Lewen

[57] ABSTRACT

An improved ground levelling machine (10) for levelling small areas of ground comprising a main frame (11), a pivotal sub-frame (15) trailing said main frame (11) and pivotally connected thereto, a scraper blade (40) carried by the main frame (11), a hopper (27) carried on the main frame (11) for the supply of soil, sand or other filling material, a plurality of ground-engaging wheels (16) supporting the sub-frame (15), power means (22) to effect pivotal movement of the sub-frame (15) relative to the main frame (11) and to thereby raise and lower the main frame (11) relative to the ground, and control means (59) for controlling the operation of the power means (11) and to in turn control the elevation of the scraper blade (40) relative to a preselected reference plane.

7 Claims, 3 Drawing Sheets

LEVELLING MACHINE

Figure 1:
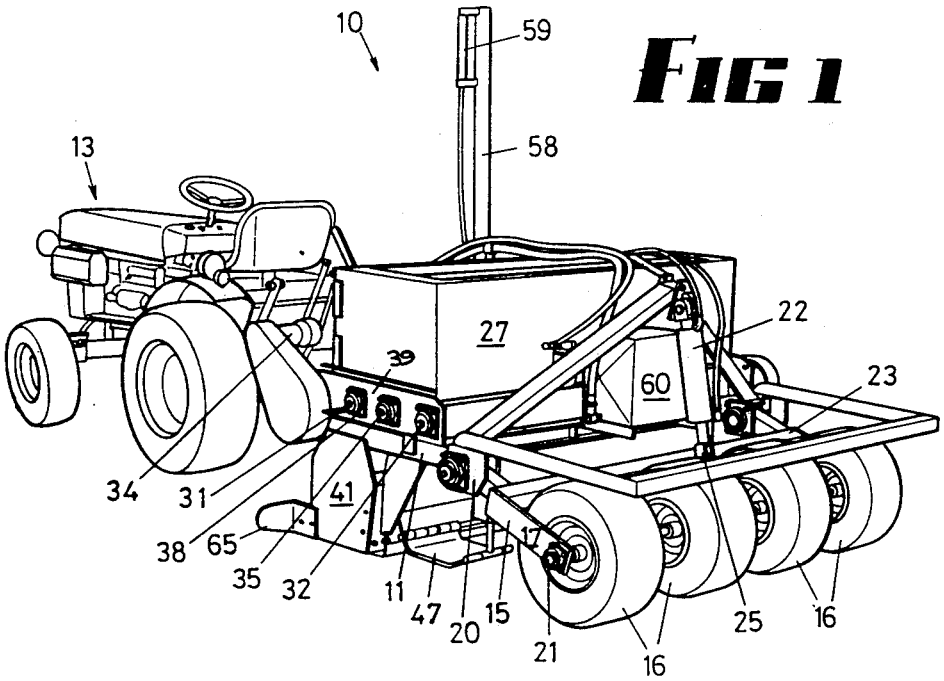

This invention relates to an improved ground levelling machine and relates particularly to an improved machine for levelling relatively small areas of ground, such as bowling greens, tennis courts, yards and the like.

More particularly, the invention concerns a ground levelling machine which is controlled by a reference signal, such as a signal produced by a laser beam.

Levelling machines, such as scrapers and graders are commonly used for roughly levelling relatively large areas of ground, and it is known to use laser beam level control systems for such earth working machines. Generally, such systems include a receiver for sensing a laser beam which is projected to define a reference plane. The receiver generates command signals in response to the relative vertical displacement of the receiver sensor with respect to the reference plane. Such command signals are used to control the position of the scraper or grader blade to maintain the blade at a substantially pre-selected elevation relative to the reference plane.

Such known laser beam controlled earth working machines are generally relatively large, are designed to work within relatively large level tolerances and are totally unsuitable for levelling relatively small areas such as bowling greens and golf tees.

It is therefore desirable to provide a machine which is able to accurately level relatively small areas.

It is also desirable to provide a machine which uses a laser beam or other beam for defining a level reference plane and to which the levelling machine can work within relatively fine tolerances.

It is also desirable to provide an improved levelling machine which is relatively cheap, simple to construct and is easy to operate.

Briefly, according to this invention, there is provided an improved levelling machine comprising a main frame, a trailing pivotal sub-frame pivotally secured to the main frame, a soil distribution scraper blade mounted on the main frame, hopper means carried on the main frame for the supply of soil, sand or other filling material, wheel means carried on the pivotal sub-frame being movable relative to the main frame to vary the height of the scraper blade relative to the ground, discharge means to control the discharge of filling material from the hopper means forwardly of the scraper blade, power means for raising and lowering of the main frame together with the scraper blade relative to the ground, said power means in turn being adapted to be controlled by control means, preferably a laser sensor means, arranged so that, in use of the machine, the elevation of the scraper blade is controlled relative to a preselected reference plane.

More specifically, according to this invention, there is provided an improved ground levelling machine comprising a main frame, a pivotal sub-frame pivotally connected to the main frame for pivotal movement about a horizontal transverse axis, a hopper carried on the main frame for containing a supply of filling material, e.g. soil or sand, an elongate soil distribution scraper blade mounted on the main frame and extending thereacross, discharge means associated with the hopper to control the discharge of filling material from the hopper, and arranged in use to discharge filling material forwardly of the scraper blade, a plurality of ground-engaging wheels carried by the sub-frame in trailing relationship to the scraper blade, power means operatively connected between the main frame and the sub-frame to effect said pivotal movement of said sub-frame relative to the main frame and in turn raising and lowering of the main frame, together with said scraper blade, relative to the ground over which the machine travels, and control means for controlling the operation of said power means to in turn control the elevation of the scraper blade relative to a preselected reference plane, whereby uneven ground can be levelled to a predetermined horizontal level.

In a preferred from of the invention, the main frame is supported at its leading end by a prime mover, such as a tractor, and the sub-frame comprises two or more (most preferably four) wheels uniformly spaced across the width of the sub-frame and carried by rearwardly extending arms at the trailing ends thereof, the arms being arranged to pivot concurrently about a transverse axis relative to the main frame. The relative position of the arms is controlled by a hydraulic ram acting between the sub-frame and a support fixed to the main frame. Thus, the hydraulic ram controls the height of the rear part of the main frame relative to the ground. The arrangement of the wheels is desirable to spread the weight of the machine evenly across its width, and to reduce the likelihood of any damage or undesirable indentation of the sub-base or of the material which has been spread and levelled by the machine. The wheels also assist to obtain uniform consolidation of the "finished" surface.

In another preferred embodiment, the scraper blade is rigidly fixed to the main frame and extends across the full width (or nearly so) of the main frame. It should be appreciated however, that the scraper blade may be movable to vary the angle of the lower blade edge relative to the main frame, to vary its angle of attack and/or to vary the height of the scraper blade edge relative to the frame.

In another form of the invention, the discharge means comprises a longitudinally extending conveyor belt driven by appropriate electrical or hydraulic motor means, the belt being positioned adjacent the outlet end of the hopper.

In yet another preferred form of the invention, the hopper means has an open bottom defined by an elongate rectangularly shaped opening having a transverse width which approximates to the width of the main frame, said conveyor belt having a width which is slightly greater than width of the hopper bottom opening and forming a floor for the hopper.

Preferably, the hopper means comprises a movable gate or flap attached adjacent its bottom end and coextensive therewith, there being manually operated control means operable to adjust the position of the gate or flap to thereby vary the vertical space between the upper belt run and the bottom edge of the gate or flap and in turn the amount of material discharged by the belt when in use.

The scraper blade may be fitted with a ski-foot which projects rearwardly and below the lower edge of the blade and is adapted to engage the ground behind the scraper blade. The ski-foot acts to raise the blade edge relative to the ground, and is used particularly when top dressing with soil onto turf, the foot causing the blade to ride up on first contact with rising ground thus protecting the turf. In this mode of use, the sub-base surface is undisturbed by the blade being permitted to "ride up"

over the "high" areas, with filling material being spread to the required level in the "low" areas between the "high" areas.

Figure 2:
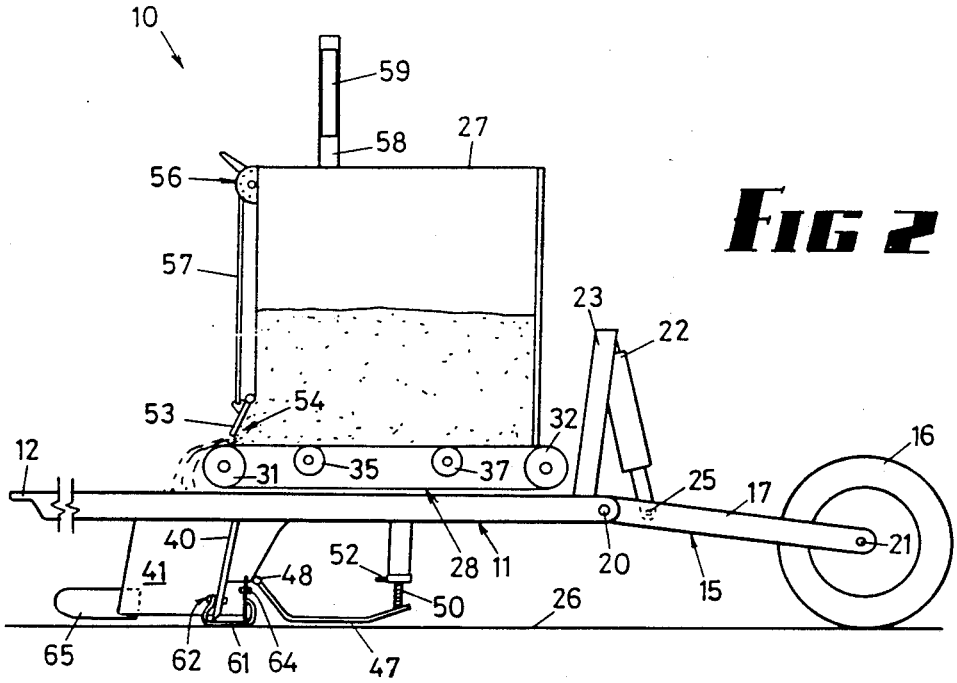
Figure 3:
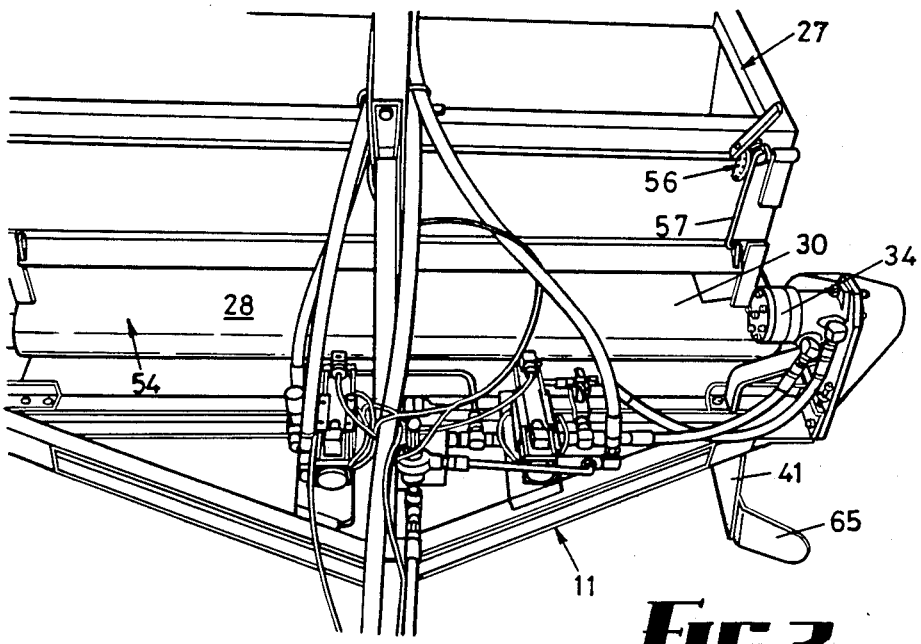
Figure 4:
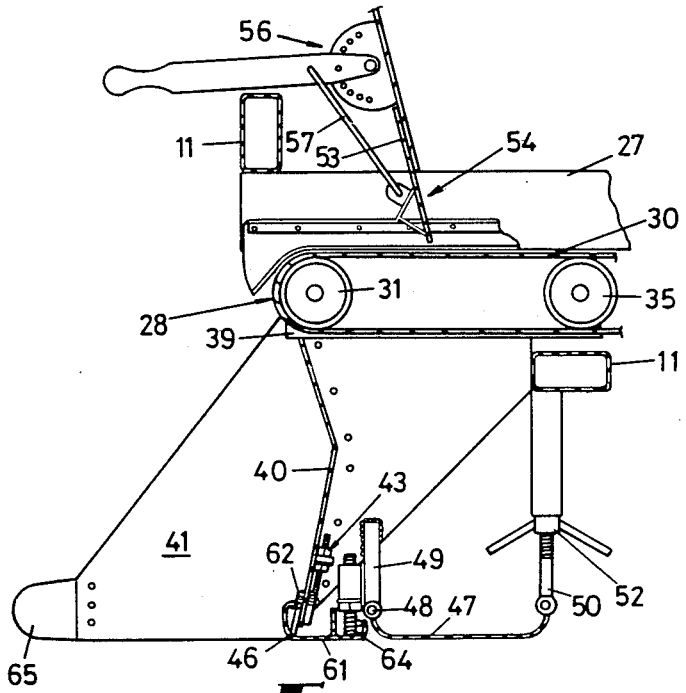
Figure 6:
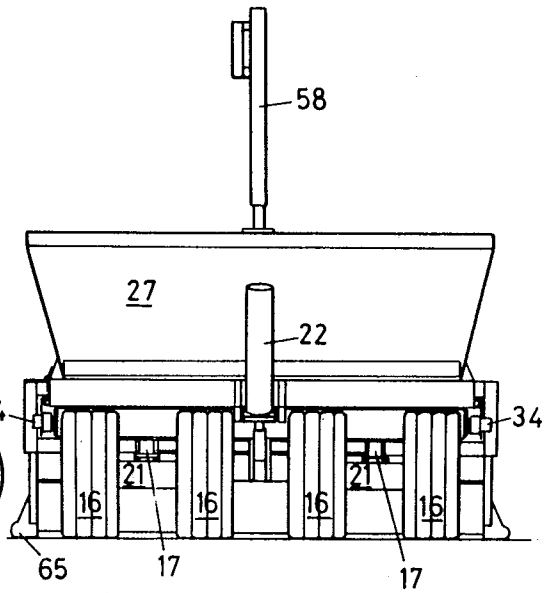
Figure 5:
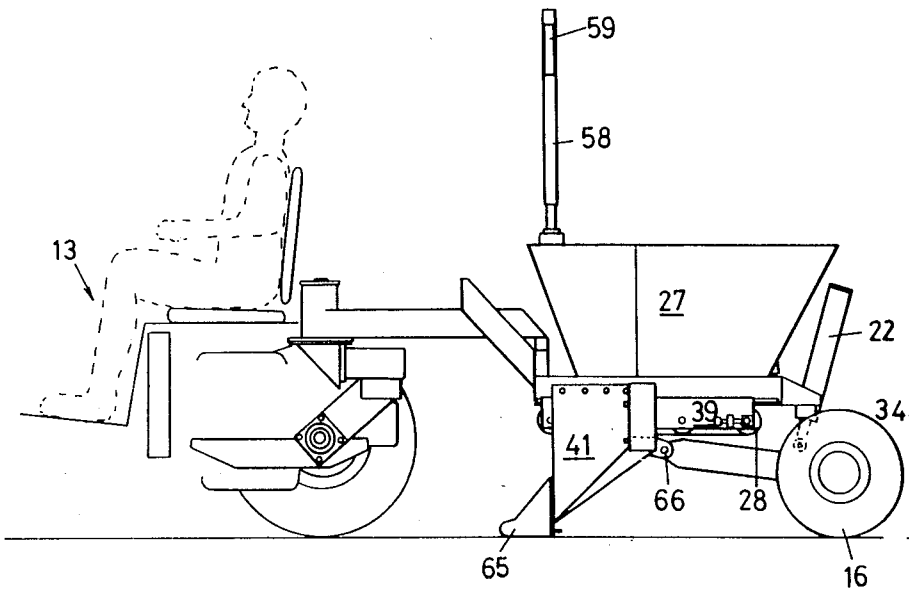

In order that the invention will be more readily understood, several embodiments thereof will now be described with reference to the accompanying drawings wherein:

FIG. 1 is a perspective view (from the rear) of one arrangement of levelling machine in accordance with a first embodiment, FIG. 2 is a schematic view of the machine shown in FIG. 1, FIG. 3 is a front perspective view of the machine of FIG. 1, FIG. 4 is a fragmentary, part-sectioned, side elevational view of an arrangement of a machine according to a second embodiment, FIG. 5 is a side elevational view of a machine according to the second embodiment, whilst FIG. 6 is an end elevational view of the machine shown in FIG. 5.

The machine 10 illustrated in FIG. 1 comprises a main frame 11 having at its front end coupling means 12 for connecting the frame 11 to a tractor or prime mover 13, and a pivotal sub-frame 15 pivotally connected to and supporting the rear end of the main frame 11 for pivotal movement about a transverse horizontal axis. The sub-frame 15 has mounted thereon a plurality, preferably four, pneumatic tyred ground-engaging wheels 16 which are rotatably supported at the trailing ends of rearwardly extending, parallel arms 17 carried by pivot links 20. In this embodiment, there are two arms 17, one at each side of the sub-frame 15, with each arm having journalled thereon an inwardly extending stub axle 21 which supports a pair of wheels 16, arranged so that the wheels are evenly spaced across the width of the sub-frame 15. The position of the sub-frame 15 relative to the main frame 11 is controlled by a hydraulic ram 22 carried by main frame members 23 and having its piston rod end 25 pivotally connected medially of the sub-frame 15. The hydraulic ram 22 thereby controls the height of the main frame 11 relative to the ground surface 26.

The main frame 11 carries an elongate rectangular hopper 27 for containing a supply of sand, soil or other similar material which is to be distributed onto the ground 26 to fill in depressions, hollows and the like. The hopper 27 extends across the main frame 11 and is secured thereto by welding, and has an open top and bottom. Located beneath the hopper 27 is a conveyor belt 28 which has a "run" slightly greater than the width of the hopper 27 and a transverse width approximating to the length of the hopper 27. In this embodiment, the floor of the hopper 27 is formed by the upper run 30 of the endless belt 28 whereby, in use, material is fed out of the hopper directly onto the belt 28 which conveys the material forwardly. The belt 28 passes over end rollers 31, 32, at least one of which is driven by a hydraulic motor 34 via a chain drive system. Transverse rollers 35, 37, which are driven by the chain drive, support the conveyor belt 28 intermediate the end rollers 31, 32, the rollers being journalled in bearings 38 located in upstanding side plates 39 at the sides of the main frame 11.

A scraper blade 40 is rigidly mounted to the main frame 11 between end guard plates 41 depending from the sides of the main frame 11. The scraper blade 40 has a predetermined angle of attack to facilitate scraping and levelling of uneven ground. In this embodiment, the blade 40 is provided with an adjustable cutting edge member 46 which is attached by bolts to the lower portion of the blade 40 and has associated therewith a manually operated adjustment mechanism 43 for adjusting the height of the cutting edge 46.

On each side of the machine, immediately behind the scraper blade 40, there is provided a pair of adjustable skid plates 47. Each skid plate 47 is pivoted to a transverse pivot 48, at its front end, the pivot 48 being carried on a depending support bar 49 welded to the side plate 41 rearwardly of the blade 40. The rear edge of each skid plate 47 is connected by means of an upwardly extending threaded rod 50 with respect to the main frame 11, there being an adjustable wing nut 52 threadably engaging the rod 50. Adjustment of the nut 52 varies the height of the rear end of the skid plate 47 relative to the main frame 11.

A door or flap 53 is pivoted along its upper edge to the front wall of the hopper 27 adjacent its bottom end, the door 53 being movable to control the amount of material moved by the conveyor belt 28 through the hopper outlet opening 54, i.e. through the opening between the belt upper run and the lower edge of the flap 53. A quadrant, lever arrangement 56 is used to manually control the relative position of the door 53 through operating rod 57. Alternatively, a hydraulic cylinder or solenoid arrangement can be used to enable the position of the door 53 to be controlled from the tractor.

It will be appreciated that the combination of the conveyor belt 28 and the hinged door 53 enables a predetermined quantity of soil, sand or other filling material to be discharged from the hopper 27 as desired. The filling material is discharged from the conveyor belt 28 to fall onto the ground in front of the scraper blade 40.

Extending upwardly from the main frame 11 is a height adjustable mast 58 carrying a laser receiver 59 which is preferably located in approximate vertical alignment with the blade 40. A control box 60 contains appropriate solenoid operated hydraulic valves (not shown) which are known in the art and which are actuated in response to signals received by the laser receiver 59 to direct hydraulic fluid to one or the other end of the double acting hydraulic ram 22. Power for operation of the solenoid operated hydraulic valves and hydraulic fluid is obtained either by connection to appropriate circuits on the prime mover 13 or by the provision of a separate power source on the main frame 11.

In operation, a laser signal transmitter (not shown) is mounted on a tripod and positioned remote from the machine 10 but in the vicinity of the ground being levelled and in line of "sight" with the machine, and a laser beam is used to define a reference plane from which the ground level is to be determined (this procedure being well-known in art). The machine of the invention is towed behind the tractor 13 which provides pressurised hydraulic fluid for the hydraulic ram 22 and electrical power for operation of the controlling solenoids. As the machine 10 is drawn across the ground, the laser receiver 59 determines the level of the scraper blade 40 relative to the reference plane, the initial level of the scraper blade being set by adjustment of the height of the laser receiver 59 to define the reference plane. Any variations in height sensed by the laser receiver 59 are translated by the solenoid operated hydraulic valves to the hydraulic ram 22 to either raise or lower the blade 40 by varying the height of the wheels 16 relative to the main frame 11. If the receiver 59 senses a low level, the blade 40 will be raised relative to the ground to thereby allow a larger amount of soil, sand or like material to flow under the blade 40 to fill up the low area to the preselected grade level and thereby maintain the ground level horizontal. The discharge of soil from the hopper 27 by the conveyor belt 28 is controlled by the operator as the conditions require to ensure a consistent flow under the blade 40. The amount of material released can be controlled by the sensed variation of level from the reference plane, and the scraper blade 40 is able to act on the released material to build up hollows and depressions in the ground to the required level. In the event of a high level being sensed, the blade 40 is lowered to arrest or reduce the amount of soil flowing under the blade 40.

It has been found that operation of the levelling machine in accordance with the invention enables very close levelling tolerances to be maintained. In some instances, such levelling tolerances can be of the order of one or two millimetres over a bowling green or similar area.

The adjustable skids 47 provided on each side of the machine act to prevent any undesired pitching or rolling of the machine 10 thus maintaining the scraper blade 40 substantially level. It will be realised that when working with fine sand or soil, the door or flap will be partly open, whilst with coarse sand or soil, the flap will be fully open.

When the levelling machine is used to top dress turf, such as a bowling green or similar area, it is desirable that the scraper blade be used for the purpose of spreading the top dressing material without damaging the turf. To this end, an elongate ski-foot 61 is attached to the lower edge portion of the scraper blade 40 by appropriate bolts 62. The foot 61 is co-extensive with and projects behind the scraper blade 40 and acts to cause the blade 40 to ride up over rising ground thereby protecting the turf. The rear portion of the ski-foot 61 is height adjustable mounted with respect to the frame 12 by an adjusting bolt and nut assembly 64.

In this embodiment, the end plates 41 are fitted with forwardly and outwardly extending wings 65 which may be formed integral with the end plates 41 or may be releasably attached thereto. The wings 65 act to prevent build-up of ridges of sand or other filling material along the line of each run of the leveling machine across the ground.

In the embodiment shown in FIGS. 4, 5 and 6, the same item numbers have been used to refer to machine parts corresponding to those in the previously described embodiment. In this embodiment, the conveyor belt 28 is mounted below the main frame 11 and the overall length of the machine is effectively reduced by having the wheel support arms 17 pivotally connected with respect to the main frame 11, to respective mountings 66 near the blade 40. The hopper 27 is provided with inwardly sloping side walls to assist flow of material therethrough, and the wheels 16 are carried on a pair of trailing arms 17 which are mounted inboard of the main frame 11. Apart from these differences, the machine is substantially in accord with that described in the first embodiment.

It will be appreciated that the conveyor belt 28 and the position of the flap 53 could be controlled, either automatically or by the operator to deposit an appropriate amount of filling material in front of the scraper blade 40, the level of which is set a predetermined distance from the reference plane defined by the laser beam. The machine, therefore, ensures that an are of ground can be levelled to very close levelling tolerances.

It will also be appreciated that the machine may be constructed as a self-propelled machine obviating the need for a tractor or other separate prime mover, and also that a contour follower sensing device in lieu of a laser beam sensor could be employed to control the raising and lowering of the soil distribution/scraper blade so as to follow the contour of the terrain over which the machine traverses. Also, a ground engaging transverse bar can be incorporated so as to lie rearwardly of the wheels for "smoothing" out any small indentations or ridges which might be formed by the wheels on the levelled surface.

We claim:

1. A mobile ground levelling machine comprising:

a main frame, a pivotal sub-frame pivotally connected to the main frame so as to lie in trailing relationship therewith, a hopper carried on the main frame for containing a supply of filling material such as soil or sand, an elongate scraper blade mounted on the main frame and extending thereacross.

an elongate ski-foot removable secured along the lower edge of said scraper blade and projecting rearwardly thereof for engagement with the ground so as to allow the scraper blade to ride smoothly over ground over which the machine travels, discharged means associated with the hopper to control the discharge of filling material from the hopper, and arranged in use to discharge filling material forwardly of the scraper blade, a plurality of ground-engaging wheels carried by and evenly spaced across the width of the sub-frame in trailing relationship to the scraper blade, power means operatively connected between the main frame and the sub-frame to effect said pivotal movement of said sub-frame relative to the main frame and in turn the raising and lowering of the main frame, together with said scraper blade, relative to the ground over which the machine travels, and control means for controlling the operation of said power means to in turn control elevation of the scraper blade relative to a preselected reference plane.

2. A machine according to claim 1 further comprising a pair of transversely spaced skid plates, each being pivotally connected at its leading end to a fixed support depending from said main frame for pivotal movement about a transverse horizontal axis, said skid plates assisting to prevent any undesired pitching or rolling of the machine and in maintaining the scraper blade substantially horizontal.

3. A machine according to claim 2 wherein the rear portion of each said skid plate has operatively associated therewith a threaded adjustment member for adjusting the height of the rear end of the skid plate relative to the main frame.

4. A mobile ground levelling machine comprising:

a main frame, a pivotal sub-frame pivotally connected to the main frame so as to lie in trailing relationship therewith, a hopper carried on the main frame for containing a supply of filling material such as soil or sand, an elongate scraper blade mounted on the main frame and extending thereacross, discharge means associated with the hopper to control the discharge of filling material from the hopper, and arranged in use to discharge filling material forwardly of the scraper blade, said discharge means comprising an endless conveyor belt extending longitudinally of said main frame, said belt being positioned to receive filling material from the hopper, and drive means to drive said belt, a plurality of ground-engaging wheels carried by and evenly spaced across the width of the sub-frame in trailing relationship to the scraper blade, power means operatively connected between the main frame and the sub-frame to effect said pivotal movement of said sub-frame relative to the main frame and in turn the raising and lowering of the main frame, together with said scraper blade, relative to the ground over which the machine travels, and control means for controlling the operation of said power means to in turn control elevation of the scraper blade relative to a preselected reference plane.

5. A machine according to claim 4 wherein said hopper comprises an elongate substantially rectangular shaped bottom opening having a transverse width which is less than the width of the main frame, said conveyor belt having a width which is greater than the width of the hopper bottom opening and forming a floor for the hopper.

6. A machine according to claim 4 further comprising an adjustable flap member hingedly attached to the front wall of said hopper and arranged to be manually operated by a control member, the lower edge of said flap defining the upper boundary of a discharge opening formed between the belt upper surface and the flap, whereby the vertical dimension of the discharge opening can be varied.

7. A machine according to claim 4 wherein said belt is driven by a hydraulic motor carried on said main frame and is electrically actuable by switch means located on the prime mover, whereby an operator is able to feed out the soil as required.

* * * * *